US008542084B1

(12) United States Patent
Newase et al.

(10) Patent No.: US 8,542,084 B1
(45) Date of Patent: Sep. 24, 2013

(54) CIRCUIT PROTECTION DEVICE AND TRIP UNIT FOR USE WITH A CIRCUIT PROTECTION DEVICE

(75) Inventors: Yatin Vilas Newase, Pune (IN); Girish Hassan Mruthunjaya, Farmington, CT (US); Hemant Kirit Anjaria, Mumbai (IN); Praneeth Kumar Madamshetty, Hyderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/419,280

(22) Filed: Mar. 13, 2012

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 75/10*** | (2006.01) |
| ***H01H 77/06*** | (2006.01) |
| ***H01H 81/04*** | (2006.01) |
| ***H01H 9/00*** | (2006.01) |

(52) U.S. Cl.
USPC ..... 335/174; 335/6; 335/38

(58) Field of Classification Search
USPC ..... 335/35, 38, 6, 172–176
See application file for complete search history.

(56) References Cited

U.S. PATENT DOCUMENTS

| | | | | |
|---|---|---|---|---|
| 3,258,560 | A * | 6/1966 | Jencks et al. | 335/36 |
| 3,309,637 | A * | 3/1967 | Jencks | 335/176 |
| 4,504,807 | A * | 3/1985 | Nar | 335/61 |
| 4,951,015 | A * | 8/1990 | Shea et al. | 335/38 |
| 5,250,918 | A * | 10/1993 | Edds et al. | 335/35 |
| 5,677,657 | A * | 10/1997 | Bagalini | 335/172 |
| 6,259,342 | B1 * | 7/2001 | Malingowski et al. | 335/202 |
| 6,407,653 | B1 * | 6/2002 | Zindler et al. | 335/6 |
| 6,750,743 | B1 * | 6/2004 | Subramanian et al. | 335/8 |
| 6,822,543 | B1 * | 11/2004 | Subramanian et al. | 335/6 |
| 6,842,096 | B2 * | 1/2005 | Ciarcia et al. | 335/35 |
| 6,847,207 | B1 | 1/2005 | Veach et al. | |
| 6,972,649 | B1 * | 12/2005 | Murthy et al. | 335/42 |
| 2002/0171519 | A1 * | 11/2002 | Lanning et al. | 335/172 |
| 2004/0059245 | A1 | 3/2004 | Watanabe et al. | |
| 2004/0227602 | A1 * | 11/2004 | Ciarcia et al. | 335/172 |
| 2008/0309188 | A1 | 12/2008 | Calley | |
| 2010/0302686 | A1 | 12/2010 | McGrath | |
| 2011/0018383 | A1 | 1/2011 | Trzynadlowski et al. | |
| 2011/0037461 | A1 | 2/2011 | Braun | |
| 2011/0088907 | A1 | 4/2011 | Xu | |
| 2011/0169365 | A1 | 7/2011 | Calley et al. | |

OTHER PUBLICATIONS

Ooleksandr Dobzhanskyi, Ernest E. Mendrela, and Andrzej M. Trzynadlowski, Analysis of Leakage Flux Losses in the Transverse Flux Permanent Magnet Generator, 978-1-61284-714-6, © 2011 IEEE.

* cited by examiner

*Primary Examiner* — Alexander Talpalatski
(74) *Attorney, Agent, or Firm* — Global Patent Operation

(57) ABSTRACT

A trip unit for use with a circuit protection device including a trip mechanism includes a support bracket and a magnet member coupled to the support bracket. The magnet member is configured to emit a magnetic field when a current is transmitted through the trip mechanism. The magnet member includes a first side portion, a second side portion, and a rear portion coupled between the first side portion and the second side portion. The trip unit also includes a pivot arm pivotally coupled to the support bracket. The pivot arm includes a first end, a second end, and a curved portion coupled to the first end and the second end. The pivot arm is configured to pivot towards the magnet member to cause the trip mechanism to interrupt the current when the current exceeds a first threshold.

14 Claims, 9 Drawing Sheets

CIRCUIT PROTECTION DEVICE AND TRIP UNIT FOR USE WITH A CIRCUIT PROTECTION DEVICE

BACKGROUND OF THE INVENTION

The present application relates generally to power systems and, more particularly, to a circuit protection device and a trip unit for use with the circuit protection device.

At least some known circuit breakers are included within electronic or magnetic trip devices that programmably interrupt a current provided to a load. The trip devices and the circuit breakers may be installed in switchgear or other power distribution systems that may provide electricity to important revenue-generating machinery and/or to machines or devices that are highly desirable to maintain in operation.

Some known circuit breakers include a trip mechanism that interrupts a current flowing through the circuit breaker when the current exceeds a current rating of the circuit breaker. For example, some known circuit breakers include a trip bar that is magnetically activated to interrupt the current flowing through the circuit breaker when the rated current is exceeded. However, at least some known circuit breakers exhibit an excessive magnetic flux leakage during operation of the circuit breaker. In addition, vibrations may be induced to the circuit breaker as a result of operating the circuit breaker in an environment including one or more machines. Such vibrations may cause one or more components of the circuit breaker to be dislodged, thus hindering the effective operation of the circuit breakers.

BRIEF DESCRIPTION OF THE INVENTION

In one aspect, a trip unit for use with a circuit protection device including a trip mechanism is provided that includes a support bracket and a magnet member coupled to the support bracket. The magnet member is configured to emit a magnetic field when a current is transmitted through the trip mechanism. The magnet member includes a first side portion, a second side portion, and a rear portion coupled between the first side portion and the second side portion. The trip unit also includes a pivot arm pivotally coupled to the support bracket. The pivot arm includes a first end, a second end, and a curved portion coupled to the first end and the second end. The pivot arm is configured to pivot towards the magnet member to cause the trip mechanism to interrupt the current when the current exceeds a first threshold.

In another aspect, a circuit protection device is provided that includes an input terminal configured to receive a current, an output terminal configured to be electrically connected to the input terminal and to transmit the current to at least one load when the output terminal is electrically connected to the input terminal, and a trip mechanism configured to electrically disconnect the input terminal from the output terminal. The circuit protection device also includes a trip bar coupled to the trip mechanism and configured to operate the trip mechanism, and a trip unit positioned about the trip bar. The trip unit includes a support bracket and a magnet member coupled to the support bracket. The magnet member is configured to emit a magnetic field when a current is transmitted through the trip mechanism. The trip unit also includes a pivot arm pivotally coupled to the support bracket. The pivot arm includes a first end, a second end, and a curved portion coupled to the first end and the second end. The pivot arm is configured to pivot towards the magnet member to cause the trip mechanism to interrupt the current when the current exceeds a first threshold.

DETAILED DESCRIPTION OF THE INVENTION

Exemplary embodiments of a trip unit and a circuit protection device are described herein. The circuit protection device includes a trip mechanism, a trip bar that activates the trip mechanism, and a trip unit that displaces the trip bar to activate the trip mechanism. The trip unit includes a support bracket, a pivot arm coupled to the support bracket, and a magnet member coupled to the support bracket. A biasing member is coupled to the support bracket and to the pivot arm to bias the pivot arm away from the magnet member. During operation, current flows through the circuit protection device and through the magnet member. The current causes the magnet member to emit a magnetic field that interacts with the pivot arm. If the current exceeds a predetermined current threshold, the strength of the magnetic field overcomes the biasing force exerted on the pivot arm by the biasing member. The pivot arm is pulled towards the magnet member and is maintained in contact with the magnet member. The position of the pivot arm contacting the magnet member facilitates reducing or eliminating a magnetic flux leakage that may otherwise occur in prior art systems.

The support bracket includes an upper support member and a lower support member. The pivot arm is coupled to the support bracket such that at least a portion of a body of the pivot arm is positioned between the upper and lower support members. A pivot edge of the pivot arm is positioned to contact a pivot area of the support bracket and to contact a pivot resting surface of the magnet member. Accordingly, the pivot arm is facilitated to be held in position within the trip unit even in the presence of vibrations that may be induced to the circuit protection device.

Figure 1:
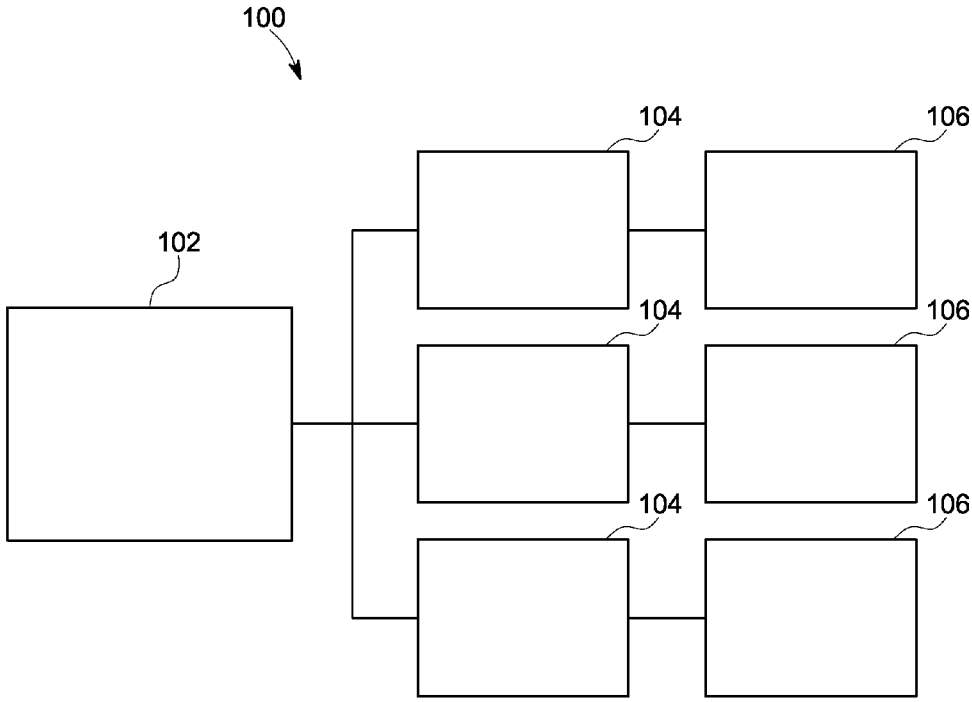
FIG. 1 is a block diagram of an exemplary power system.

FIG. 1 is a block diagram of an exemplary power system 100. In an exemplary embodiment, power system 100 includes an electric power source 102, one or more circuit protection devices 104, and one or more loads 106.

Electric power source 102 may include, for example, a steam turbine generator, a wind turbine generator, a solar panel array, and/or any other source that generates and/or provides electrical power (i.e., current and voltage) within power system 100. More specifically, electric power source 102 provides electrical power to loads 106 through circuit protection devices 104. While a single electric power source 102 is illustrated in FIG. 1, it should be recognized that any suitable number of electric power sources 102 may be included within power system 100 and may be coupled to circuit protection devices 104.

In an exemplary embodiment, each circuit protection device 104 is coupled to electric power source 102 to receive power therefrom. Each circuit protection device 104 is also coupled to at least one respective load 106 to protect load 106 from excessive current that may be received from electric power source 102. More specifically, each circuit protection device 104 is configured to "trip" (i.e., to electrically disconnect electric power source 102 from load 106) if the current received from electric power source 102 exceeds one or more thresholds. For example, circuit protection device 104 may trip if the current received exceeds a first current threshold and/or if the current received exceeds a second current threshold for a predetermined amount of time. In one embodiment, circuit protection devices 104 are circuit breakers. Alternatively, circuit protection devices 104 are relays, switchgear, or other devices that are activated to electrically disconnect loads 106 from electric power source 102 when the current received exceeds one or more thresholds.

Each load 106 is coupled to a circuit protection device 104 and receives power from electric power source 102 through circuit protection device 104. In an exemplary embodiment, loads 106 include, without limitation, one or more motors, fans, pumps, computer systems, appliances, and/or any other device or machine that consumes electrical power.

Figure 2:
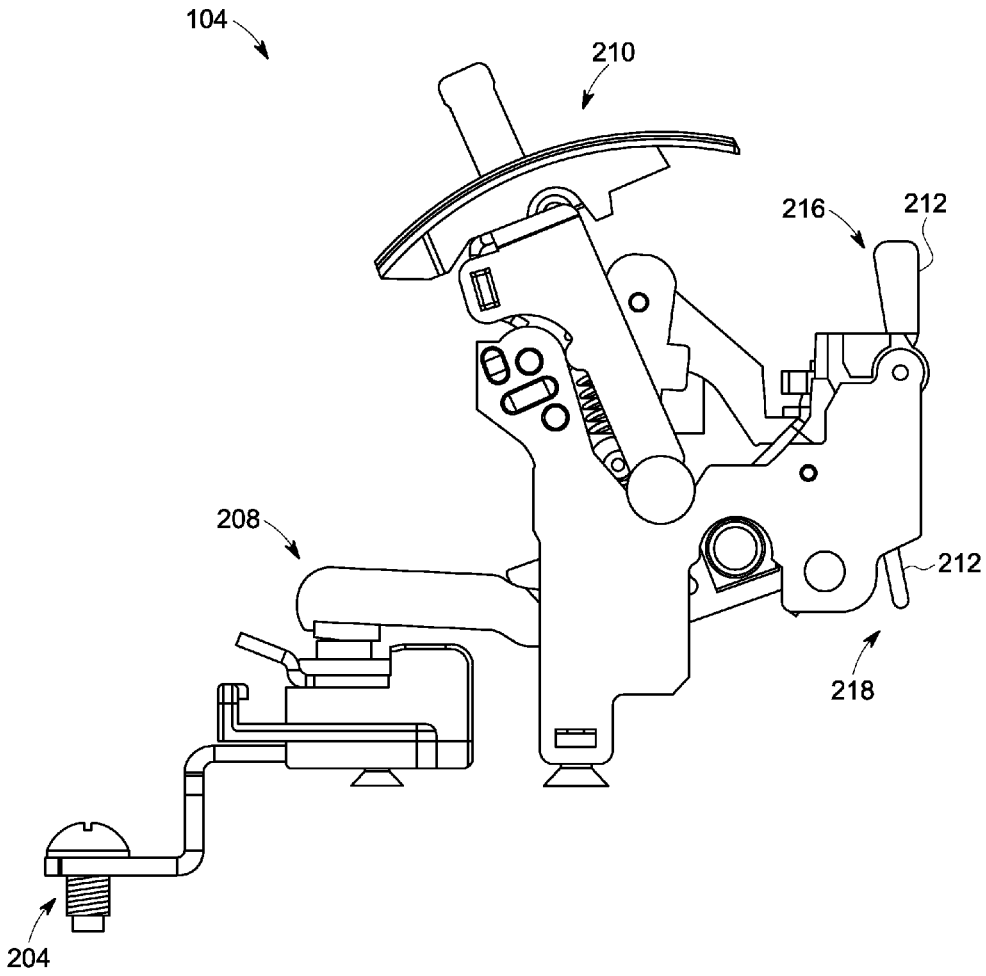
FIG. 2 is a partial side view of an exemplary circuit protection device that may be used with the power system shown in FIG. 1.
Figure 3:
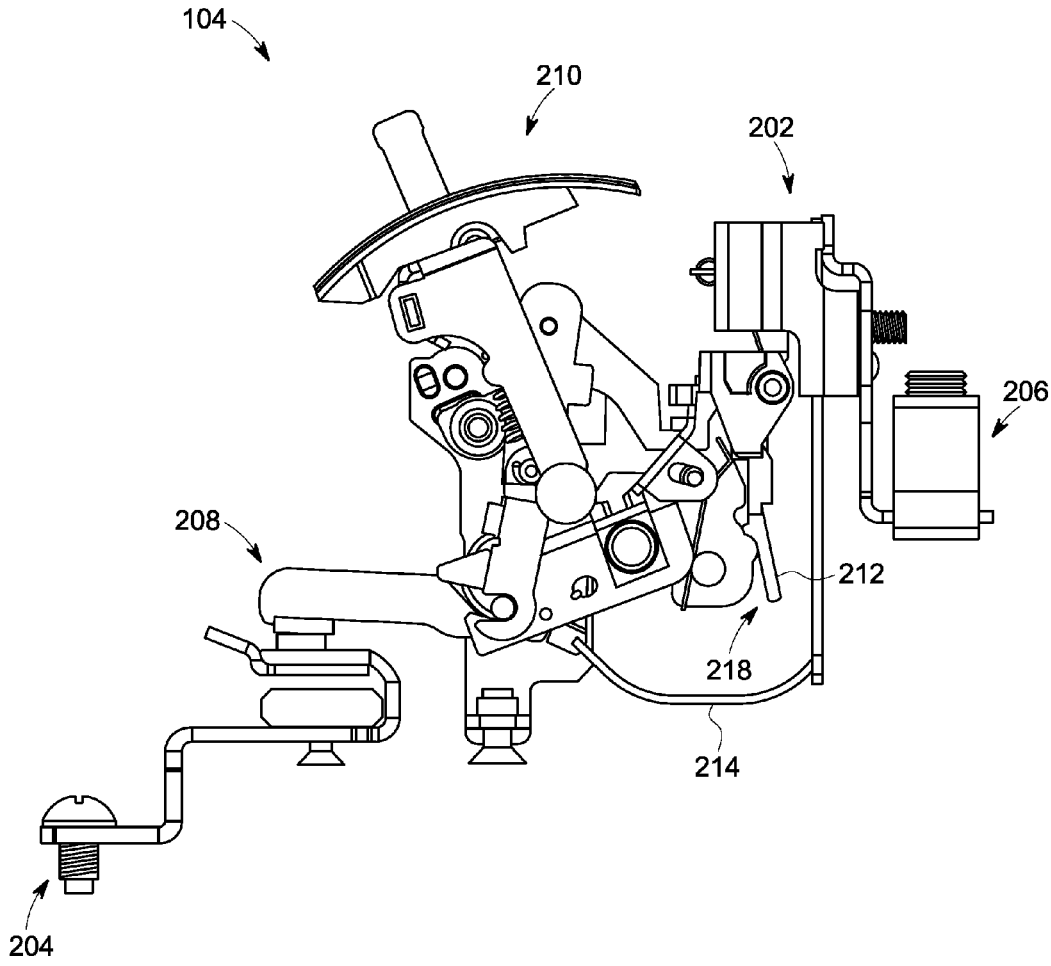
FIG. 3 is a partial side view of the circuit protection device shown in FIG. 2 including a trip unit.

FIG. 2 is a partial side view of an exemplary circuit protection device 104 that may be used with power system 100 (shown in FIG. 1). FIG. 3 is a partial side view of circuit protection device 104 including a trip unit 202. In an exemplary embodiment, circuit protection device includes an input terminal 204, an output terminal 206, a contact arm 208, a trip mechanism 210, a trip bar 212, and trip unit 202. FIG. 3 illustrates trip unit 202 substantially enclosing at least a portion of trip bar 212, while FIG. 2 illustrates circuit protection device 104 with trip unit 202 omitted to more clearly view trip bar 212. In addition, FIG. 3 illustrates circuit protection device 104 including output terminal 206, while FIG. 2 illustrates circuit protection device 104 with output terminal 206 omitted.

In an exemplary embodiment, input terminal 204 is coupled to electric power source 102 (shown in FIG. 1) and receives electrical current from source 102. Output terminal 206 is coupled to load 106 (shown in FIG. 1) and transmits current received from electric power source 102 to load 106.

Contact arm 208 is electrically coupled to input terminal 204 and receives current from terminal 204. Contact arm 208 is raised by trip mechanism 210 to electrically disconnect contact arm 208 (and output terminal 206) from input terminal 204, and is lowered by trip mechanism 210 to electrically connect contact arm 208 (and output terminal 206) to input terminal 204. Current received by contact arm 208 is transmitted to trip unit 202 and to output terminal 206 by a conductor 214, such as a copper wire.

In an exemplary embodiment, trip mechanism 210 is a switch that is operated by trip bar 212 and/or by a user to electrically disconnect input terminal 204 from output terminal 206 and to electrically connect input terminal 204 to output terminal 206. For example, a user may operate trip mechanism 210 to cause contact arm 208 to be raised to electrically disconnect input terminal 204 from output terminal 206, and may operate trip mechanism 210 to cause contact arm 208 to be lowered to electrically connect input terminal 204 to output terminal 206. In addition, if the current received from electric power source 102 through input terminal 204 exceeds one or more thresholds, trip unit 202 may cause trip bar 212 to activate trip mechanism 210, thus causing trip mechanism 210 to raise contact arm 208 and electrically disconnect input terminal 204 from output terminal 206.

Trip bar 212, in an exemplary embodiment, is a rigid bar that is coupled to trip mechanism 210. Trip bar 212 is operated, or displaced, by trip unit 202 to cause trip mechanism 210 to raise contact arm 208. More specifically, trip unit 202 displaces an upper portion 216 of trip bar 212, and trip bar 212 pivots about an axis (not shown). A lower portion 218 of trip bar 212 impacts trip mechanism 210 and causes trip mechanism 210 to raise contact arm 208.

In an exemplary embodiment, trip unit 202 displaces upper portion 216 of trip bar 212 when the current received from electric power source 102 through input terminal 204 and contact arm 208 exceeds one or more thresholds. More specifically, if the current received exceeds a first threshold, trip unit 202 causes trip bar 212 to activate trip mechanism 210. If the current received exceeds a second threshold for a predetermined amount of time, trip unit 202 causes trip bar 212 to activate trip mechanism 210. In an exemplary embodiment, the first threshold is higher than the second threshold such that trip unit 202 causes trip mechanism 210 to activate (using trip bar 212) when a first, substantially instantaneous, current that exceeds the first threshold is received, and also causes trip mechanism 210 to activate when a second current (lower than the first current) is received that persists for a predetermined amount of time.

Figure 4:
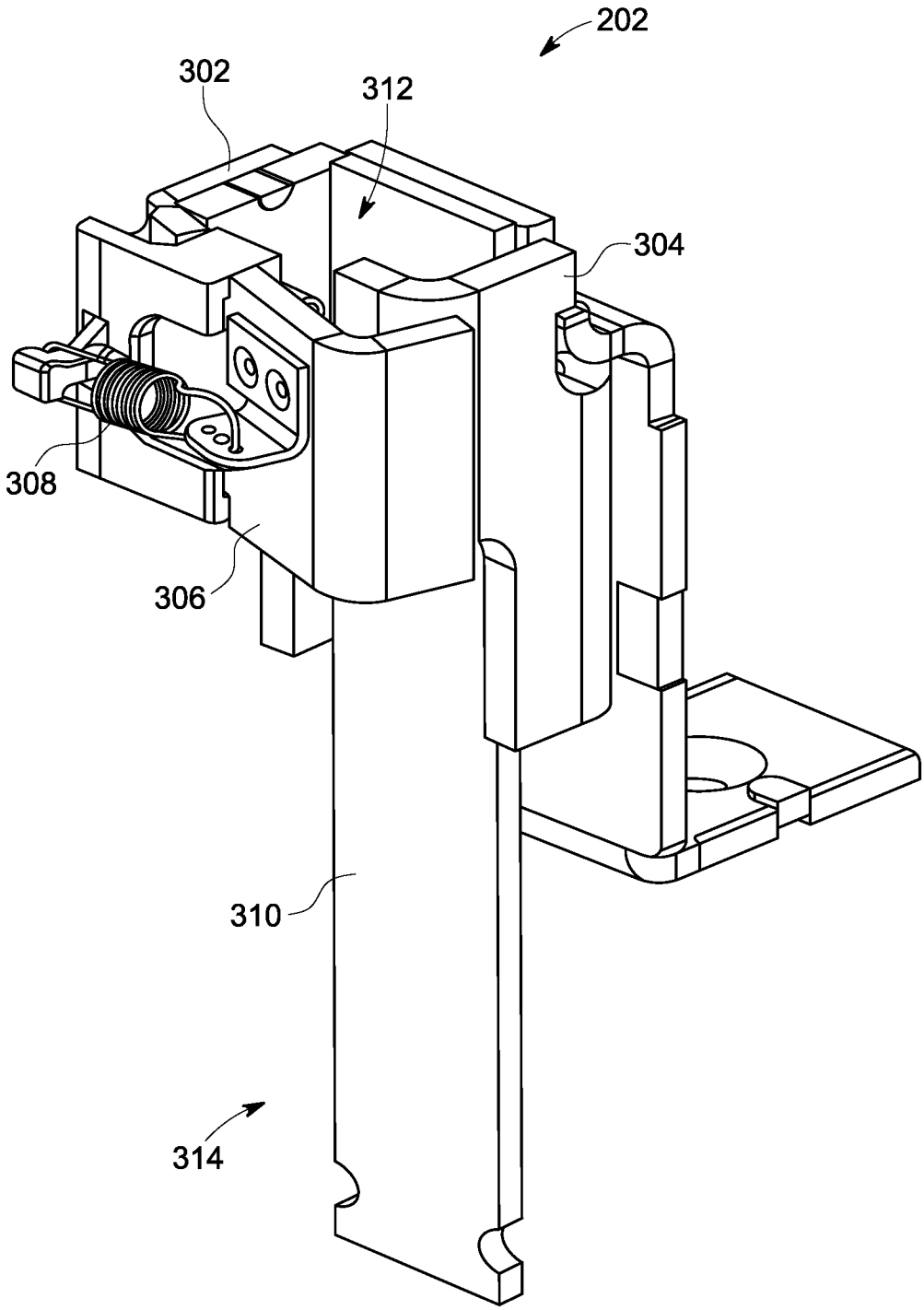
FIG. 4 is a perspective view of an exemplary trip unit that may be used with the circuit protection device shown in FIGS. 2 and 3.

FIG. 4 is a perspective view of an exemplary trip unit 202 that may be used with circuit protection device 104 (shown in FIG. 2). In an exemplary embodiment, trip unit 202 includes a support bracket 302, a magnet member 304, a pivot arm 306, a biasing member 308, and a deflection bar 310.

In an exemplary embodiment, each of support bracket 302, magnet member 304, pivot arm 306, biasing member 308, and deflection bar 310 are manufactured from one or more metallic and/or metallic alloy materials. More specifically, in an exemplary embodiment, deflection bar 310 is manufactured from a bimetal material such that a first layer is formed from a first metal and a second layer is formed from a second metal such that deflection bar 310 deflects when heated. Alternatively, support bracket 302, magnet member 304, pivot arm 306, biasing member 308, and/or deflection bar 310 are manufactured from any other suitable material that enables trip unit 202 to function as described herein. For example, support bracket 302 may be manufactured from a plastic material or another nonconductive material.

In an exemplary embodiment, support bracket 302 is coupled to magnet member 304 and is pivotally coupled to pivot arm 306. Magnet member 304 is also coupled to deflection bar 310. In addition, pivot arm 306 is biased towards support bracket 302 (and away from magnet member 304) by a biasing member 308, such as a spring.

Support bracket 302, magnet member 304, pivot arm 306, and deflection bar 310 at least partially define a cavity 312 within trip unit 202. In an exemplary embodiment, at least a portion of trip bar 212, such as upper portion 216 of trip bar 212 (both shown in FIG. 2), is positioned within cavity 312.

During operation, current is received from input terminal 204 (shown in FIG. 2) and is channeled through deflection bar 310 and magnet member 304. The current causes a magnetic field to be emitted or generated by magnet member 304 and the magnetic field interacts with pivot arm 306. If the amount of current exceeds a first threshold, a force of the magnetic field causes pivot arm 306 to overcome the biasing force of biasing member 308 and causes pivot arm 306 to be drawn towards magnet member 304. Pivot arm 306 impacts upper portion 216 of trip bar 212 and displaces upper portion 216, thus causing trip mechanism 210 to activate.

In addition, the current causes deflection bar 310 to heat, and to deflect based on the amount of heat generated by the current. More specifically, a lower portion 314 of deflection bar 310 deflects away from magnet member 304 in an increasing amount as the current transmitted through deflection bar 310, and the amount of heat generated within deflection bar 310, increases and/or persists over time. If the current exceeds a second threshold for a predetermined amount of time, lower portion 314 of deflection bar 310 impacts lower portion 218 (shown in FIG. 2) of trip bar 212 and displaces lower portion 218, thus causing trip mechanism 210 to activate. Accordingly, as described herein, trip unit 202 causes trip mechanism 210 to activate and electrically disconnect input terminal 204 from output terminal 206 if the current received from input terminal 204 exceeds a first threshold and/or if the current received from input terminal 204 exceeds a second threshold for a predetermined amount of time.

Figure 5:
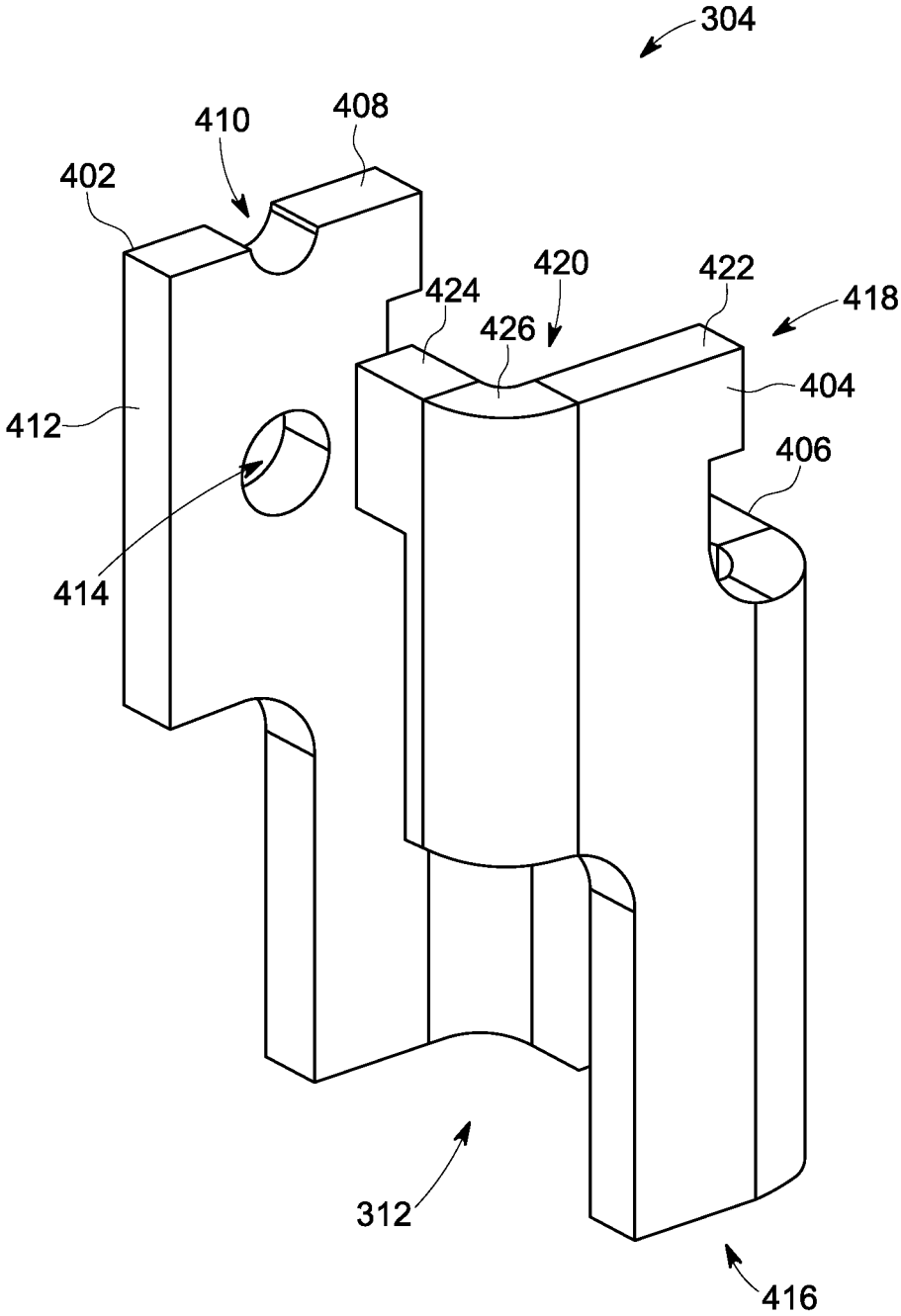
FIG. 5 is a perspective view of an exemplary magnet member that may be used with the trip unit shown in FIG. 4.

FIG. 5 is a perspective view of an exemplary magnet member 304 of trip unit 202 (shown in FIG. 4). In an exemplary embodiment, magnet member 304 includes a first side portion 402, an opposing second side portion 404, and a rear portion 406 coupled to first side portion 402 and to second side portion 404, i.e., between first side portion 402 and second side portion 404. In an exemplary embodiment, each of first side portion 402, second side portion 404, and rear portion 406 are manufactured from a conductive material, such as steel or another suitable metal or metallic alloy. In an exemplary embodiment, magnet member 304 is an electromagnet that emits a magnetic field when current is transmitted through member 304.

First side portion 402 includes an upper surface 408 that includes an alignment cavity 410 formed therein. In an exemplary embodiment, alignment cavity 410 is shaped to receive an alignment member (not shown in FIG. 5) of support bracket 302. In one embodiment, alignment cavity 410 has a substantially semi-circular cross-section. Alternatively, the cross-section of alignment cavity 410 has any other suitable shape configured to receive the alignment member of support bracket 302.

First side portion 402 also includes a pivot resting surface 412 extending from upper surface 408. Pivot resting surface 412 is substantially planar and cooperates with pivot arm 306 and support bracket 302 to enable arm 306 to pivot towards, and away from, magnet member 304 while facilitating preventing pivot arm 306 from being dislodged from support bracket 302. In addition, an opening 414 is defined within first side portion 402 for use in coupling magnet member 304 to support bracket 302. More specifically, a bolt or another coupling mechanism (not shown) is inserted through opening 414 and is coupled to support bracket 302 such that magnet member 304 is maintained in contact with support bracket 302.

Second side portion 404 includes a lower section 416, and an upper section 418 that forms a magnet arm 420. In an exemplary embodiment, magnet arm 420 includes a first end 422 and a second end 424, and a curved portion 426 extending between first end 422 and second end 424. Magnet arm 420 has a shape that is complementary with, and at least partially conforms to, pivot arm 306 such that at least a portion of pivot arm 306 wraps around curved portion 426 to contact second end 424, curved portion 426, and/or first end 422 when pivot arm 306 is fully extended towards magnet arm 420. In addition, magnet arm 420 facilitates adjusting a force of a magnetic flux that is emitted or generated when current flows through magnet member 304. More specifically, as current flows through magnet arm 420, curved portion 426 and second end 424 cause the force of the magnetic flux to be substantially reduced, or "flattened," proximate to curved portion 426 and second end 424.

First side portion 402, rear portion 406, and second side portion 404 at least partially define cavity 312. In an exemplary embodiment, cavity 312 is sized and shaped to receive at least a portion of trip bar 212, such as upper portion 216. More specifically, upper portion 216 of trip bar 212 is positioned within cavity 312 such that, when the current flowing through magnet member 304 exceeds a threshold, pivot arm 306 displaces portion 216 and causes trip mechanism 210 to trip.

Figure 6:
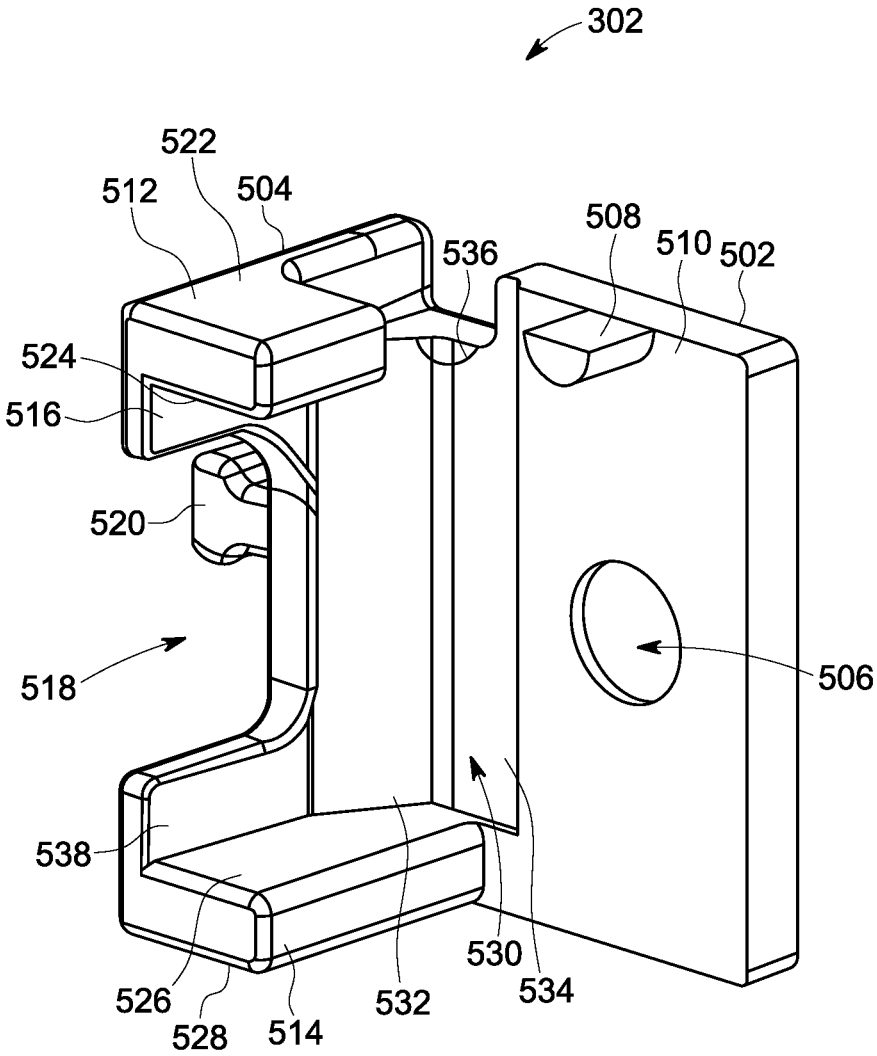
FIG. 6 is a perspective view of an exemplary support bracket that may be used with the trip unit shown in FIG. 4.

FIG. 6 is a perspective view of an exemplary support bracket 302 of trip unit 202 (shown in FIG. 4). In an exemplary embodiment, support bracket 302 includes a mounting portion 502 and a retention portion 504 coupled to mounting portion 502. More specifically, mounting portion 502 is coupled substantially perpendicularly to retention portion 504.

Mounting portion 502 is configured to couple to magnet member 304, such as to first side portion 402 (both shown in FIG. 5). More specifically, mounting portion 502 includes an opening 506 defined therein that is substantially similar to opening 414 (shown in FIG. 5) of first side portion 402 such that a bolt or another suitable coupling member may be inserted through opening 506 and opening 414 to couple first side portion 402 to mounting portion 502.

Mounting portion 502 also includes an alignment member 508 extending from an inner surface 510 of portion 502. Alignment member 508 is shaped to substantially match the shape of alignment cavity 410 (shown in FIG. 5). Accordingly, when magnet member 304 is coupled to support bracket 302, alignment member 508 is positioned within alignment cavity 410 to facilitate aligning magnet member 304 (e.g., first side portion 402) with support bracket 302 (e.g., mounting portion 502).

Retention portion 504 includes an upper support member 512, a lower support member 514, and a body 516 extending therebetween. A recess 518 is formed within body 516. Recess 518 is shaped to receive a portion of pivot arm 306 when pivot arm 306 is biased away from magnet member 304. Retention portion 504 also includes a biasing anchor 520 that receives an end (not shown) of biasing member 308 (shown in FIG. 4).

Upper support member 512 protrudes from body 516 to facilitate retaining pivot arm 306 within support bracket 302 by limiting a movement of arm 306 in an upward direction. Lower support member 514 protrudes from body 516 to facilitate retaining pivot arm 306 within support bracket 302 by limiting the movement of arm 306 in a downward direction. As used herein, the term "upward direction" refers to a direction from lower support member 514 towards upper support member 512. A "downward direction" refers to a direction from upper support member 512 towards lower support member 514.

Upper support member 512 includes an upper surface 522 and an opposing lower surface 524, and lower support member 514 includes an upper surface 526 and an opposing lower surface 528. Pivot arm 306 is positioned between lower surface 524 of upper support member 512 and upper surface 526 of lower support member 514 such that arm 306 is limited from moving in the upward direction and the downward direction. Accordingly, upper support member 512 and lower support member 514 facilitate preventing pivot arm 306 from undesirably being dislodged during operation of trip unit 202.

In an exemplary embodiment, a pivot area 530 is defined at an intersection of mounting portion 502 and retention portion 504. Pivot area 530 includes a first surface 532 and a second surface 534 intersecting at an angle 536 that is greater than about 90 degrees and that is less than about 180 degrees. In an exemplary embodiment, second surface 534 is substantially parallel with inner surface 510 of mounting portion 502, and second surface 534 is angled with respect to an inner surface 538 of body 516. The angled orientation of pivot area 530 (i.e., first surface 532 and second surface 534 intersecting to form angle 536) facilitates enabling pivot arm 306 to freely pivot through at least a portion of pivot area 530.

Figure 7:
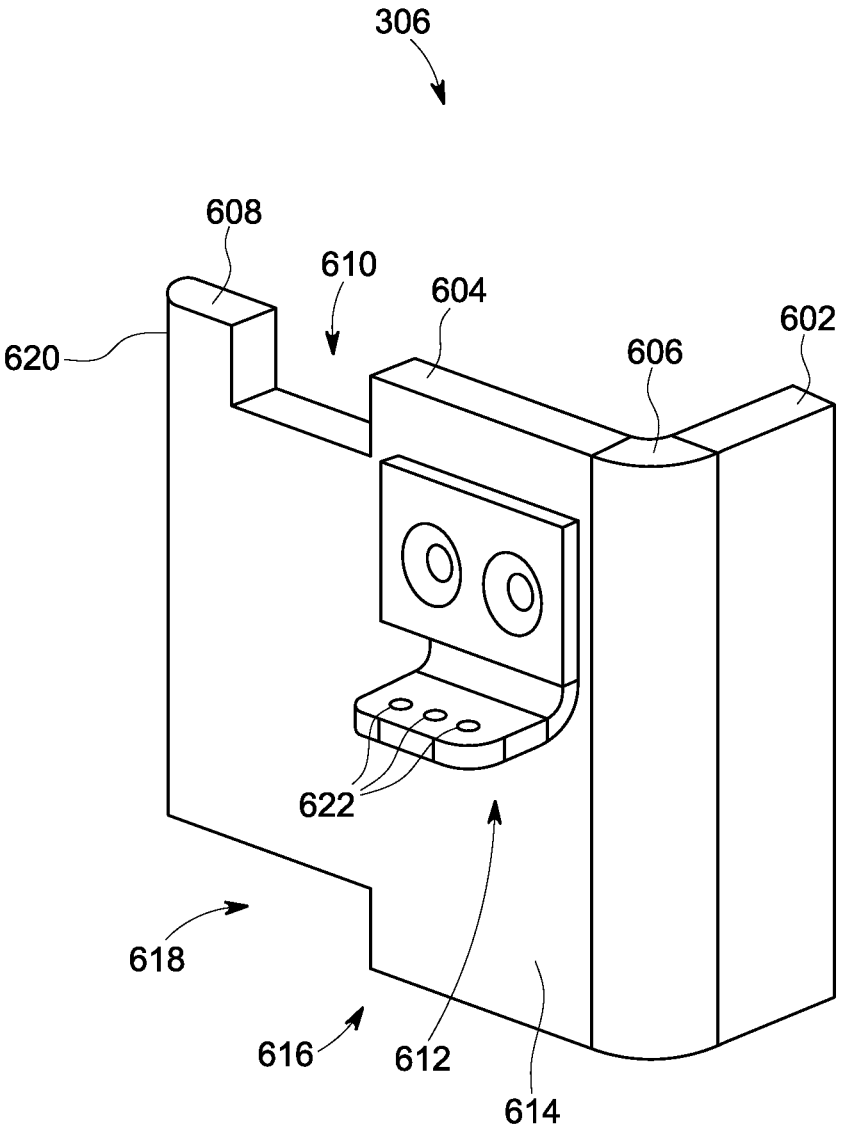
FIG. 7 is a perspective view of an exemplary pivot arm that may be used with the trip unit shown in FIG. 4.

FIG. 7 is a perspective view of an exemplary pivot arm 306 of trip unit 202 (shown in FIG. 4). In an exemplary embodiment, pivot arm 306 includes a first end 602, a second end 604, and a curved portion 606 coupled between first end 602 and second end 604. First end 602 has a shape that substantially conforms to first end 422 of magnet member 304, second end 604 has a shape that substantially conforms to second end 424 of member 304, and curved portion 606 has a shape that substantially conforms to curved portion 426 of member 304 such that at least a portion of first end 602, second end 604, and curved portion 606 are substantially flush with first end 422, second end 424, and curved portion 426, respectively, of member 304 when pivot arm 306 is maintained in contact with member 304.

In addition, pivot arm 306 includes a retention flange 608 and a retention recess 610 formed between retention flange 608 and second end 604. A biasing bracket 612 is coupled to an outer surface 614 of pivot arm 306, and a lower end 616 of pivot arm 306 includes a notched portion 618 formed therein.

In an exemplary embodiment, pivot arm 306 is coupled to support bracket 302 (shown in FIG. 4) such that upper support member 512 is positioned within retention recess 610 (i.e., between retention flange 608 and second end 604). At least a portion of pivot arm 306 (e.g., the portion of arm 306 between retention recess 610 and notched portion 618) is positioned between upper support member 512 and lower support member 514 such that lower support member 514 is positioned within notched portion 618. A pivot edge 620 of pivot arm 306 is positioned in contact with pivot area 530 (shown in FIG. 6). In an exemplary embodiment, pivot edge 620 is substantially wedge shaped (i.e., a cross-sectional area of pivot edge 620 is substantially shaped as a wedge). When pivot arm 306 is positioned within support bracket 302 and magnet member 304 is coupled to bracket 302, pivot arm 306 is enabled to pivot about pivot edge 620 and pivot area 530.

Biasing member 308 (shown in FIG. 4) is coupled to biasing bracket 612 and to biasing anchor 520 such that member 308 extends between support bracket 302 and pivot arm 306. Biasing member 308 biases first end 602 of pivot arm 306 away from magnet member 304. In one embodiment, biasing bracket 612 includes a plurality of openings 622 for biasing member 308 to couple to for adjusting a biasing force exerted upon pivot arm 306 by member 308.

Figure 8:
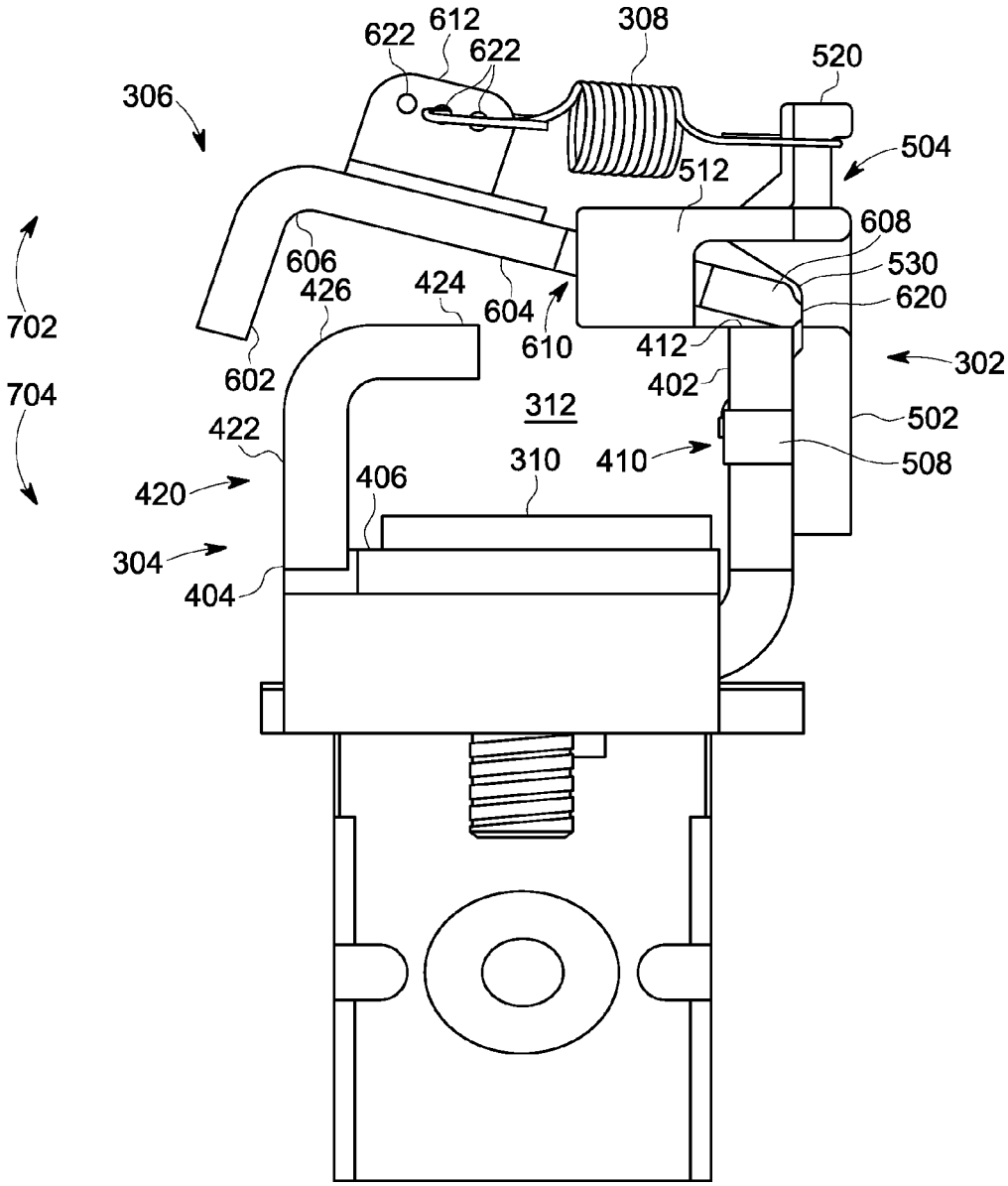
FIG. 8 is a top view of the trip unit shown in FIG. 4.

FIG. 8 is a top view of trip unit 202. During operation, current is received from input terminal 204 of trip mechanism 210 (both shown in FIG. 2) and is transmitted through magnet member 304 and deflection bar 310. The current causes a magnetic field to be emitted or generated by magnet member 304. The magnetic field creates a magnetic force that acts upon pivot arm 306. In addition, biasing member 308 generates a biasing force that acts upon pivot arm 306 in opposition to the magnetic force.

If the biasing force exerted by biasing member 308 is greater than the magnetic force acting on pivot arm 306 as generated by magnet member 304, pivot arm 306 is pulled away from magnet member 304 in a first rotational direction 702. However, if the magnetic force is greater than the biasing force, pivot arm 306 is pulled towards magnet member 304 in a second rotational direction 704 such that arm 306 contacts member 304. More specifically, second end 604 of pivot arm 306 contacts second end 424 of magnet member 304, curved portion 606 of arm 306 contacts curved portion 426 of member 304, and/or first end 602 of arm 306 contacts first end 422 of member 304. Accordingly, a shape of pivot arm 306 at least partially conforms to a shape of magnet member 304 to enable at least a portion of pivot arm 306 to be maintained in contact with magnet member 304 such that a magnetic flux leakage from magnet member 304 is facilitated to be reduced or eliminated.

In addition, when pivot arm 306 is pulled towards magnet member 304, arm 306 contacts upper portion 216 of trip bar 212 (both shown in FIG. 2) and displaces upper portion 216, thus causing trip mechanism 210 to trip. When the magnetic field is removed and/or when the magnetic force is less than the biasing force, biasing member 308 pulls pivot arm 306 away from magnet member 304 in first rotational direction 702.

Figure 9:
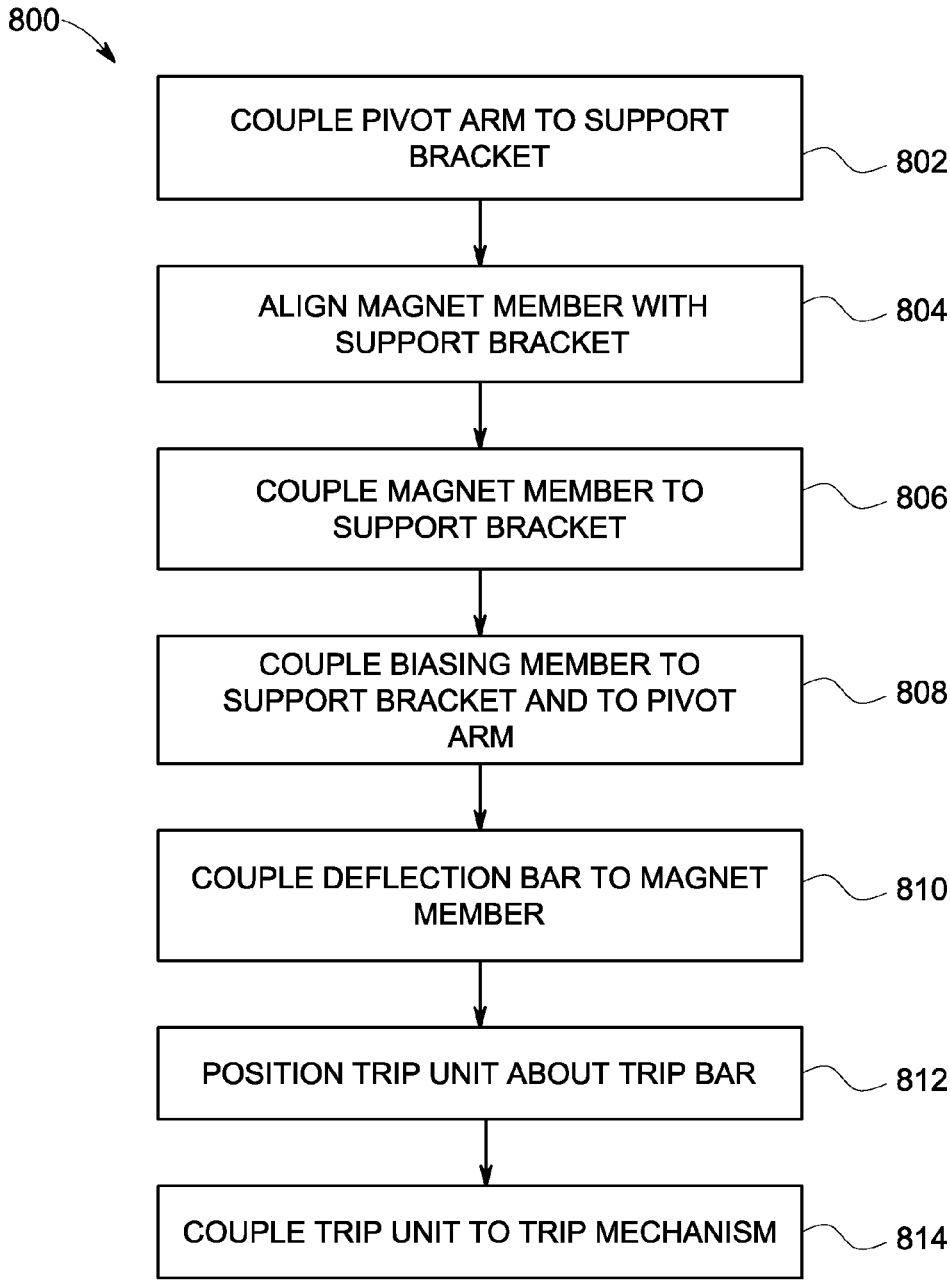
FIG. 9 is a flow diagram of an exemplary method of assembling a trip unit that may be used to assemble the trip unit shown in FIG. 4.

FIG. 9 is a flow diagram of an exemplary method 800 of assembling a trip unit that may be used to assemble trip unit 202 (shown in FIG. 4). A substantially L-shaped pivot arm, such as pivot arm 306, is coupled 802 to a support bracket, such as support bracket 302 (both shown in FIG. 4). More specifically, pivot arm 306 is inserted into support bracket 302 such that upper support member 512 is positioned within retention recess 610 of pivot arm 306 and lower support member 514 is positioned within notched portion 618 of arm 306. Pivot edge 620 of pivot arm 306 is positioned in contact with pivot area 530.

A substantially U-shaped magnet member, such as magnet member 304 (shown in FIG. 4), is aligned 804 with support bracket 302 by inserting alignment member 508 of support bracket 302 into alignment cavity 410 of magnet member 304. Magnet member 304 is coupled 806 to support bracket 302 by inserting a bolt or another coupling mechanism through opening 414 (shown in FIG. 5) of magnet member 304 and through opening 506 (shown in FIG. 6) of support bracket 302. Accordingly, first side portion 402 of magnet member 304 is maintained in contact with mounting portion 502 of support bracket 302.

A biasing member 308 (shown in FIG. 4), such as a spring, is coupled 808 to biasing anchor 520 (shown in FIG. 6) of support bracket 302 and to biasing bracket 612 (shown in FIG. 7) of pivot arm 306. In one embodiment, a biasing force exerted by biasing member 308 on pivot arm 306 is adjusted by coupling biasing member 308 to biasing bracket 612 through different openings 622 (shown in FIG. 7).

Deflection bar 310 (shown in FIG. 4) is coupled 810 to magnet member 304. Trip unit 202 is positioned 812 about trip bar 212 such that trip bar 212 is positioned within cavity 312 (shown in FIG. 4), and trip unit 202 is coupled 814 to trip mechanism 210.

It should be noted that when trip unit 202 is assembled, pivot arm 306 is free to rotate, or pivot, about pivot edge 620 through at least a portion of pivot area 530 (i.e., through at least a portion of angle 536 (shown in FIG. 6)). Pivot arm 306 is limited from moving in an upward direction and a downward direction by upper support member 512 and lower support member 514. It should also be noted that unless otherwise specified, the order of the steps of method 800 may be interchanged as desired.

Exemplary embodiments of a circuit protection device and a trip unit for use with a circuit protection device are described above in detail. The circuit protection device and the trip unit are not limited to the specific embodiments described herein but, rather, components of the device and/or assembly may be utilized independently and separately from other components described herein. Further, the described operations and/or components may also be defined in, or used in combination with, other systems, methods, and/or devices, and are not limited to practice with only the circuit protection device or the trip unit as described herein.

Although the present invention is described in connection with an exemplary circuit protection device, embodiments of the invention are operational with numerous other circuit protection devices, or other systems or devices. The circuit protection device described herein is not intended to suggest any limitation as to the scope of use or functionality of any aspect of the invention. In addition, the circuit protection device described herein should not be interpreted as having any dependency or requirement relating to any one or combination of components illustrated in the exemplary operating environment.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A trip unit for use with a circuit protection device including a trip mechanism, said trip unit comprising:
- a support bracket comprising:
  - a mounting portion;
  - a retention portion coupled substantially perpendicularly to said mounting portion; and
  - a pivot area positioned at an intersection of said mounting portion and said retention portion;
- a magnet member coupled to said support bracket and configured to emit a magnetic field when a current is transmitted through the trip mechanism, said magnet member comprising a first side portion, a second side portion, and a rear portion coupled between said first side portion and said second side portion; and
- a pivot arm pivotally coupled to said support bracket, said pivot arm comprising:
  - a first end;
  - a second end positioned substantially perpendicular to said first end;
  - a curved portion coupled to said first end and said second end, wherein said pivot arm is configured to pivot towards said magnet member to cause the trip mechanism to interrupt the current when the current exceeds a first threshold; and
  - a pivot edge configured to be positioned in contact with said pivot area to enable said pivot arm to pivot through at least a portion of said pivot area.

2. A trip unit in accordance with claim 1, further comprising a deflection bar coupled to said magnet member and configured to cause the trip mechanism to interrupt the current when the current exceeds a second threshold for a predetermined amount of time.

3. A trip unit in accordance with claim 1, wherein said magnet member comprises a curved portion having a shape that substantially conforms to a shape of said curved portion of said pivot arm.

4. A trip unit in accordance with claim 1, wherein said magnet member comprises an alignment cavity configured to receive at least a portion of said support bracket.

5. A trip unit in accordance with claim 4, wherein said support bracket comprises an alignment member that protrudes from a surface of said support bracket, wherein said alignment member is configured to be received within said alignment cavity when said magnet member is coupled to said support bracket.

6. A trip unit in accordance with claim 1, further comprising a biasing member coupled to said support bracket and to said pivot arm, said biasing member configured to bias said pivot arm away from said magnet member if the current does not exceed the first threshold.

7. A trip unit in accordance with claim 1, wherein said pivot edge is substantially wedge shaped.

8. A circuit protection device comprising:
- an input terminal configured to receive a current;
- an output terminal configured to be electrically connected to said input terminal and to transmit the current to at least one load when said output terminal is electrically connected to said input terminal;
- a trip mechanism configured to electrically disconnect said input terminal from said output terminal;
- a trip bar coupled to said trip mechanism and configured to operate said trip mechanism; and
- a trip unit positioned about said trip bar and comprising:
  - a support bracket comprising:
    - a mounting portion;
    - a retention portion coupled substantially perpendicularly to said mounting portion; and
    - a pivot area positioned at an intersection of said mounting portion and said retention portion;
  - a magnet member coupled to said support bracket and configured to:
    - receive the current from said input terminal; and
    - emit a magnetic field based on the current received; and
  - a pivot arm pivotally coupled to said support bracket, said pivot arm comprising:
    - a first end;
    - a second end positioned substantially perpendicular to said first end;

a curved portion coupled to said first end and said second end, wherein said pivot arm is configured to pivot towards said magnet member to cause said trip bar to operate said trip mechanism to interrupt the current when the current exceeds a first threshold; and a pivot edge configured to be positioned in contact with said pivot area to enable said pivot arm to pivot through at least a portion of said pivot area.

9. A circuit protection device in accordance with claim 8, further comprising a deflection bar coupled to said magnet member and configured to cause said trip mechanism to interrupt the current when the current exceeds a second threshold for a predetermined amount of time.

10. A circuit protection device in accordance with claim 8, wherein said magnet member comprises a curved portion having a shape that substantially conforms to a shape of said curved portion of said pivot arm.

11. A circuit protection device in accordance with claim 8, wherein said magnet member comprises an alignment cavity configured to receive at least a portion of said support bracket.

12. A circuit protection device in accordance with claim 11, wherein said support bracket comprises an alignment member that protrudes from a surface of said support bracket, wherein said alignment member is configured to be received within said alignment cavity when said magnet member is coupled to said support bracket.

13. A circuit protection device in accordance with claim 8, further comprising a biasing member coupled to said support bracket and to said pivot arm, said biasing member configured to bias said pivot arm away from said magnet member if the current does not exceed the first threshold.

14. A circuit protection device in accordance with claim 8, wherein said pivot edge is substantially wedge shaped.

* * * * *